US006464210B1

(12) United States Patent
Teran et al.

(10) Patent No.: US 6,464,210 B1
(45) Date of Patent: Oct. 15, 2002

(54) FLUID DISSOLUTION APPARATUS

(75) Inventors: Alfredo J. Teran, Cape Canaveral, FL (US); Richard G. Wood, Merritt Island, FL (US); Nidal A. Samad, Merritt Island, FL (US); Timothy N. Tyndall, Cape Canaveral, FL (US); Wesley Todd Willoughby, Merritt Island, FL (US)

(73) Assignee: Agrimond, LLC, Cape Canaveral, FL (US)

( * ) Notice: Subject to any disclaimer, the term of this patent is extended or adjusted under 35 U.S.C. 154(b) by 0 days.

(21) Appl. No.: 10/063,115

(22) Filed: Mar. 22, 2002

(51) Int. Cl.[7] ..... B01F 3/04; B01F 15/04

(52) U.S. Cl. ..... 261/79.2; 366/165.4; 366/165.5; 366/173.2

(58) Field of Search ..... 261/37, 66, 79.2, 261/DIG. 75; 210/218, 220, 221.2, 752; 366/165.1, 165.4, 165.5, 173.1, 173.2

(56) References Cited

U.S. PATENT DOCUMENTS 1,213,887 A * 1/1917 Krause ..... 261/79.2
3,425,669 A * 2/1969 Gaddis ..... 366/165.5
3,495,384 A * 2/1970 Alliger ..... 261/79.2
3,990,870 A * 11/1976 Miczek ..... 261/79.2
4,834,343 A * 5/1989 Boyes ..... 261/79.2
5,865,995 A 2/1999 Nelson
5,881,574 A * 3/1999 Petrich ..... 261/79.2
5,968,352 A 10/1999 Ditzler
6,054,046 A 4/2000 Nelson
6,065,860 A * 5/2000 Fuchsbichler ..... 366/165.5
6,090,294 A 7/2000 Teran et al.
6,106,731 A 8/2000 Hayes
6,207,064 B1 3/2001 Gargas
6,238,912 B1 * 5/2001 Moore et al. ..... 261/79.2
6,254,838 B1 7/2001 Goede

OTHER PUBLICATIONS

The Injector Sparger Gas Contacting System; REMCO Engineering, Water Systems and Controls; http://www.rem-co.com/injector.html; Nov. 12, 2001.

* cited by examiner

*Primary Examiner*—C. Scott Bushey
(74) *Attorney, Agent, or Firm*—Anton J. Hopen; Smith & Hopen, PA

(57) ABSTRACT

An apparatus for the efficient dissolution of fluids, both gas to liquid and liquid to liquid. A flow splitter divides the influent to an upper and lower stream. The lower stream is injected with a gas and the gas-enriched lower stream is subsequently discharged proximate to the bottom of a contactor in tangential fashion. The upper stream is discharged in similar tangential fashion proximate to the top of the contactor producing a vortex flow pattern. The countercurrent flow of the gas-enriched lower stream and upper stream ensures a high degree of dissolution of the gas in the liquid. Alternatively, two liquids of differing densities may be dissolved together with the present invention.

16 Claims, 4 Drawing Sheets

FLUID DISSOLUTION APPARATUS

BACKGROUND OF INVENTION

1. Field of the Invention

This invention relates, generally, to the dissolution of a fluids and more particularly to fluid contacting systems.

2. Description of the Prior Art

There are many types of fluid contacting systems. A contact tank, or chamber, is commonly used to transfer a gas bubble to the bulk of the process water in a contacting system. Efficient mixing of the gas and the process water within the contacting system is critical in maximizing the performance of the system. More specifically, when a gas has a low solubility in water, the effective transfer of the gas to the liquid is critical.

Several types of fluid contactors have been developed with the most common including contactors that use diffused bubbles, positive pressure injection, negative pressure, a turbine mixer tank, and a packed tower. Diffused bubble contactors can have either a concurrent or countercurrent configuration. Countercurrent bubble contactors are the most efficient and cost effective of the alternatives and have been employed in the design of most gas dissolution systems. Positive pressure injection is most often employed with a U-tube where an eductor or Venturi tube provides negative pressure means to inject gas into the liquid flow.

Continuing efforts are being made to improve gas-liquid contacting tanks. By way of example, U.S. Pat. No. 5,968,352 to Ditzler that describes a contact chamber with concentric inner and outer tanks. Water is injected with gas prior to the water entering the concentric tanks. The gas-enriched water enters the tank configuration via a conduit and is discharged near the bottom of the inner tank so that it flows upwards to the top of the inner tank. As the water nears the top of the inner tank, the water overflows to the concentric outer tank where the water then flows downwards to the bottom of the outer tank and out.

U.S. Pat. No. 6,207,064 to Gargas describes a cylindrical contact tank that discharges gas-containing water near the upper end of the tank in a tangential orientation. The tangential discharge causes a turbulent swirling motion of the water within the tank to promote further gas contact with the water.

Similarly, U.S. Pat. No. 6,054,046 to Nelson describes a contact tank having a vortex chamber that creates a downward spiral flow of the gas-containing liquid stream.

The prior art does not utilize a concurrent flow of gas and liquid for facilitating the dissolution of gas in a liquid without the use of positive pressure or diffusers.

A fluid contacting system that improves the transfer of fluid contact which is simple in design and economical to maintain and operate is needed.

However, in view of the prior art considered as a whole at the time the present invention was made, it was not obvious to those of ordinary skill in the pertinent art how the identified needs could be fulfilled.

SUMMARY OF INVENTION

The long-standing but heretofore unfulfilled need for a contacting apparatus that increases the fluid contact that is simple in design and economical to maintain and operate is now provided in the form of a new, useful and non-obvious device.

The contacting apparatus includes a contactor and a liquid source that is in fluid communication with a flow splitter.

The flow splitter is in further interposing fluid communication with a flow adjustment means and a gas injection means. The flow splitter splits the liquid influent into upper and lower streams. The upper stream is directed to the flow adjustment means and the lower stream is directed to the gas injection means. The flow adjustment means is in fluid communication with the splitter and an upper fluid flow directing means. The flow adjustment means is adjusted so that the upper stream flows at a desired flow rate. The upper stream is discharged tangentially at the desired flow rate via the upper fluid flow directing means. The upper fluid flow directing means is disposed proximate to the top of the contactor and at a preselected downward angle so that the upper stream discharge direction and velocity produces a downward vortex flow within the contactor. The gas injection means is in fluid communication with a gas source and is interposed between the flow splitter and a lower fluid flow directing means. The gas from the gas source is injected concurrently with the lower stream via the gas injection means to produce a gas-enriched lower stream. The lower fluid flow directing means is disposed proximate to the bottom of the contactor and at a preselected upward angle so that the gas-enriched lower stream discharge direction and velocity produces an upward vortex flow that is counter to the downward vortex flow within the contactor. A mixing zone is created by the upward and downward vortices because the gas-enriched lower stream flows in an upwardly direction and the upper stream flows downwardly to an outlet thereby producing a mixing countercurrent flow within the contactor. The outlet is disposed proximate to the bottom of the contactor. A gas collector disposed proximate to the top of the contactor collects gas not transferred to the liquid and recirculates the collected gas to an outlet conduit.

In an alternative embodiment of the invention, a fluid having a density lighter that the liquid may be substituted for the gas. Thus, a first liquid and a second liquid may be dissolved using the present invention provided they exhibit distinct densities. Accordingly, the second liquid rises in counter-vortex relation to the denser first liquid flowing downward.

It should be noted that virtually any gas including, but not limited to, ozone, ammonia, oxygen, carbon dioxide, nitrogen and the like may be dissolved using this novel invention. Additionally, the present invention may be used to dissolve together two fluids, each in a liquid state.

Potential applications for the present invention include, but are not limited to, laundry cleaning, swimming pool applications, produce washing, fish farm maintenance, hog farm effluent processing, toxic waste decontamination, industrial chemical processing, and the like.

An important object of the present invention is to provide an improved contacting apparatus that increases the efficiency of the transfer of gas to a liquid and thereby reduces operating costs.

Another object of the present invention is to provide a contacting apparatus that reduces maintenance requirements.

These and other important objects, advantages, and features of the invention will become clear as this description proceeds.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
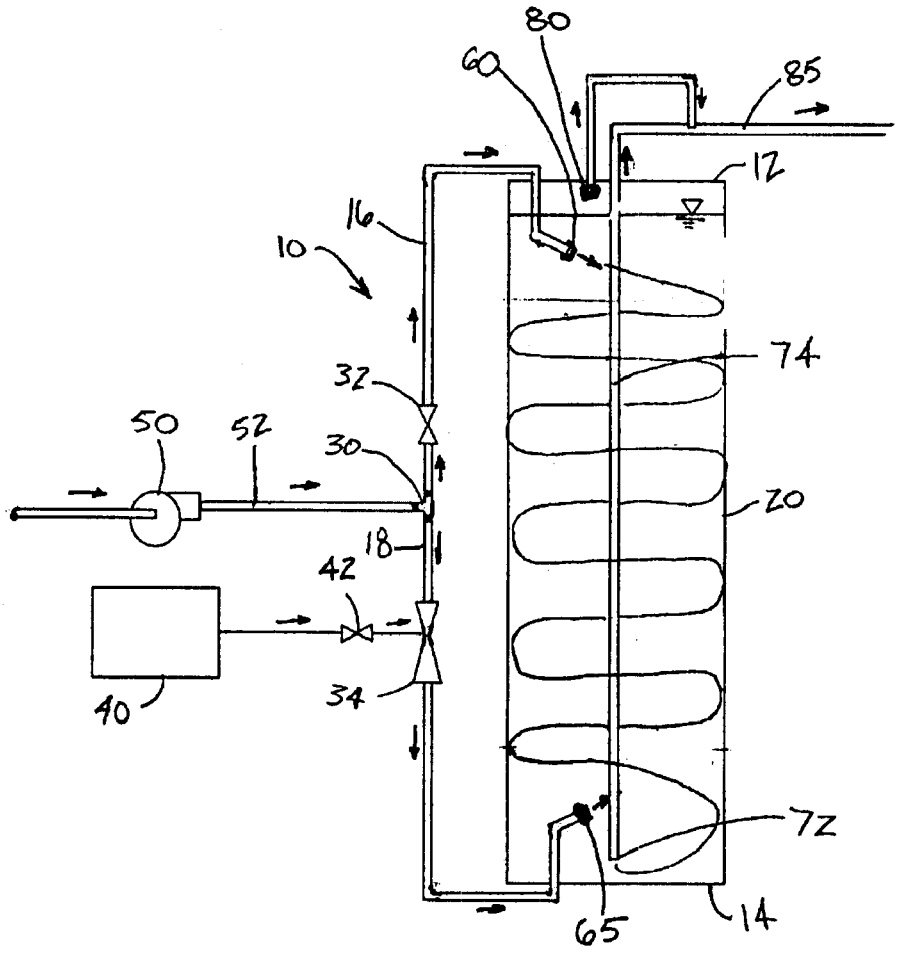
FIG. 1 is a front view of the present invention.

Referring now to FIG. 1, it will there be seen that the reference numeral 10 denotes an illustrative embodiment of the contacting apparatus as a whole. Contactor 20 is a longitudinally extending elongate hollow enclosure having a closed top 12, a closed bottom 14, and a gas tight interior space therein. Any suitably sized commercially available contactor may be utilized in the apparatus of the present invention. For example, Model #1016963, manufactured by Harvel. Similarly, any conventional flange and flange gaskets may be employed, for example Model C80272 and C80700 manufactured by Colonial.

As shown in FIG. 1, supply pump 50 pumps liquid from a remote source to flow splitter 30 via inlet conduit 52. Any commercially available, suitable liquid pump may be utilized in the present application, for example Model #DB 1-½ manufactured by Jacuzzi. Preferably, flow splitter 30 is a conventional T-fitting. Alternatively, any means known in the art to split the flow of a liquid may be utilized as a flow splitter including but not limited to a Y-fitting.

Flow splitter 30 splits the flow into two streams so that an upper stream flows to influent conduit 16 and a lower stream flows to influent conduit 18. The upper stream flows to a valve or flow adjustment means 32. Preferably, this flow adjustment means 32 is a ball valve. Alternatively, any flow adjustment means known in the art may be utilized to control the flow rate. The flow rate of the upper stream is adjusted to a preselected flow rate by the liquid flow adjustment means 32. As flow adjustment means 32 increases the flow rate of the upper stream, the lower stream flow is proportionally decreased. The desired flow rate of the upper stream ranges from at least 50 percent to not more than 80 percent, while the desired flow rate of the lower stream ranges from at least 20 percent to not more than 50 percent. In the preferred embodiment the desired flow rate of the upper stream is about 80% of the total flow and the remaining 20% flow is directed to the lower stream. The precise flow split between the upper and lower stream of the present invention is determined by the specific requirements of an application and adjusted accordingly.

Gas injection means 34 injects gas into the lower stream. In the preferred embodiment, the gas injection means is an eductor. The lower stream is designed to flow through a constricted area of eductor 34 at a flow rate that creates a negative pressure at a small orifice within eductor 34. The increase in flow velocity of the stream through the eductor 34 results in reduced pressure. The negative pressure created by the increased velocity of the lower stream draws the gas into the lower stream flow. The gas is entrained in the lower stream and carried along as very fine bubbles. A gas generation means or source 40 provides gas to eductor 34 and because of the negative pressure within the eductor, gas is drawn into the lower stream flow from gas source 40 without the use of a pump or high pressure. Furthermore, using eductor 34 allows gas to not only be introduced into eductor 34 without a pump, eductor 34 allows gas to be introduced into the lower stream without a pump. Eliminating the requirement for a pump subsequently reduces associated energy costs and maintenance costs. The eductor is a low maintenance, reliable mechanism that can be used efficiently in the gas-liquid contacting process. Contacting systems that use diffusers must use a pump to increase the gas pressure to overcome the liquid pressure at the bottom of a contactor so that the gas can be introduced within the contactor. The liquid pressure within the contactor can be relatively substantial in a contactor that has more than a few feet of liquid depth. Prior art diffusers also require a high level of maintenance and are subject to clogging.

The lower stream flow rate is sufficient to create negative pressure with the majority of the total flow volume of the apparatus being directed to the upper stream in the preferred embodiment. After the lower stream passes through eductor 34, the lower stream is now entrained with a high concentration of gas. The gas-enriched lower stream is then introduced into the interior of contactor 20 using lower fluid flow directing means 65. Preferably, lower fluid flow directing means is a nozzle 65. Alternatively, any means known in the art to direct the flow of a fluid may be utilized as the lower fluid flow directing means including but not limited to nozzles or angled apertures defined within influent conduit 18. Lower fluid flow directing means 65 introduces the lower stream tangentially to the inside wall of the contactor producing a vortex flow.

Additionally, fluid flow directing means 65 is angled upwardly to discharge the gas-enriched flow towards the top of contactor 20. As the lower stream is discharged, gas that was not transferred to the lower stream within eductor 34 is released into contactor 20 as gas bubbles. The gas bubbles travel in the vortex flow path created by the liquid discharge. The gas bubbles travel circumferentially in the contactor while slowly floating upwardly along the vortex flow path. The length of travel for the gas bubble is greatly increased by the vortex flow path thereby increasing the gas-liquid contact time. This is a significant feature for gasses that are not highly soluble in liquids, such as ozone, that require a substantial length of gas-liquid contact time to be transferred to a target liquid. The vortex flow path reduces the incidence of stagnant liquid in the contactor.

In the preferred embodiment of the present invention, the majority of the total flow is introduced into the contactor via conduit 52 directed to the upper stream. The upper stream flows through flow adjustment means 32 and is discharged through upper fluid flow directing means 60. Upper fluid flow directing means 60 introduces the upper stream tangentially to the inside wall of the contactor producing a vortex flow. Upper fluid flow directing means 65 is angled downwardly so that the discharge flow is directed to outlet 72 located proximate to the bottom of contactor 20. The upper stream travels downwardly and encounters the rising vortex flow of the gas-enriched liquid lower stream that was discharged from lower fluid flow directing means 65. Preferably, nozzle 60 is the upper fluid flow directing means. Alternatively, any means known in the art to direct the flow of a fluid may be utilized as the upper fluid flow directing means including but not limited to nozzles or angled apertures defined within influent conduit 16.

The countercurrent flow between the upper and lower streams produces an advantageous mixing zone or interface that increases the gas-liquid contact time and thereby increases the dissolution of the gas into the liquid.

First end 72 of discharge conduit 74 is disposed proximate to the bottom of contactor 20 and liquid (hereinafter effluent) flows up outlet conduit 74 under pressure. Gas not transferred to the liquid is released from the liquid and collects at the top of the contactor. Gas collector 80 located proximate to the top of contactor 20 collects the gas and recirculates the gas to outlet conduit 85 of the effluent. This further increases the dissolution of gas into the effluent.

Figure 2:
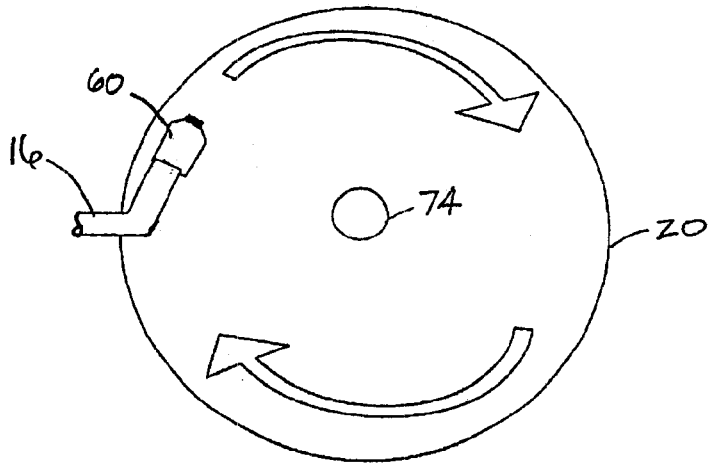
FIG. 2 is a partial top view of the present invention showing the direction of flow within the contactor.
Figure 3:
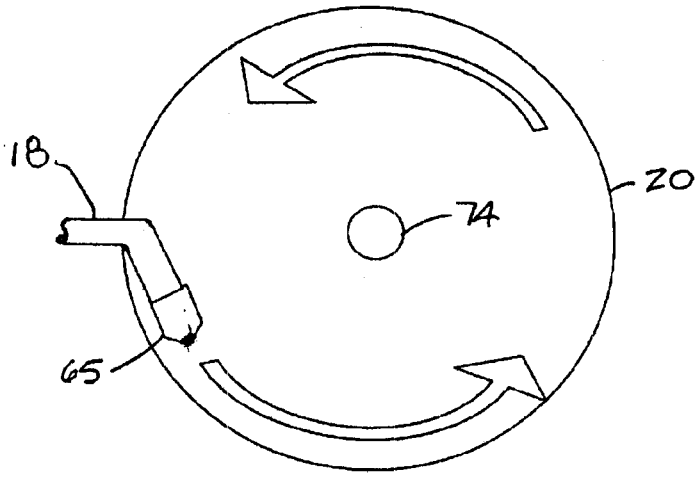
FIG. 3 is partial bottom view of the present invention showing the direction of flow within the contactor.

Referring now to FIG. 2, the upper fluid flow directing means 60 is coupled or formed integrally with the upper influent conduit 16. More specifically, upper fluid flow directing means 60 is configured tangentially to the inside wall of contactor 20 about the horizontal plane. In the vertical plane, fluid directing means 16 is disposed at about a 45 degree downward angle, or not less than 25 degrees and not more than 50 degrees downward angle. Similarly, lower fluid flow directing means 65 as shown in FIG. 3 is configured tangentially to the inside wall of contactor 20 about the horizontal plane and at about a 45 degree upward angle in the vertical plant, or not less than 25 degrees and not more than 50 degrees upward angle. The angles of the fluid flow directing means 60, 65 are adjusted as needed to maximize the dissolution of gas within the liquid. In the preferred embodiment, the vortex flow produced by the lower flow directing means 65 and upper fluid flow directing means 60 cooperate with one another providing a vortex flowing in a single direction, either clockwise or counterclockwise. The upper and lower fluid flow directing means 60, 65 may be configured to produce opposing vortex flows so that a more turbulent mixing zone is created within contactor 20.

Figure 4:
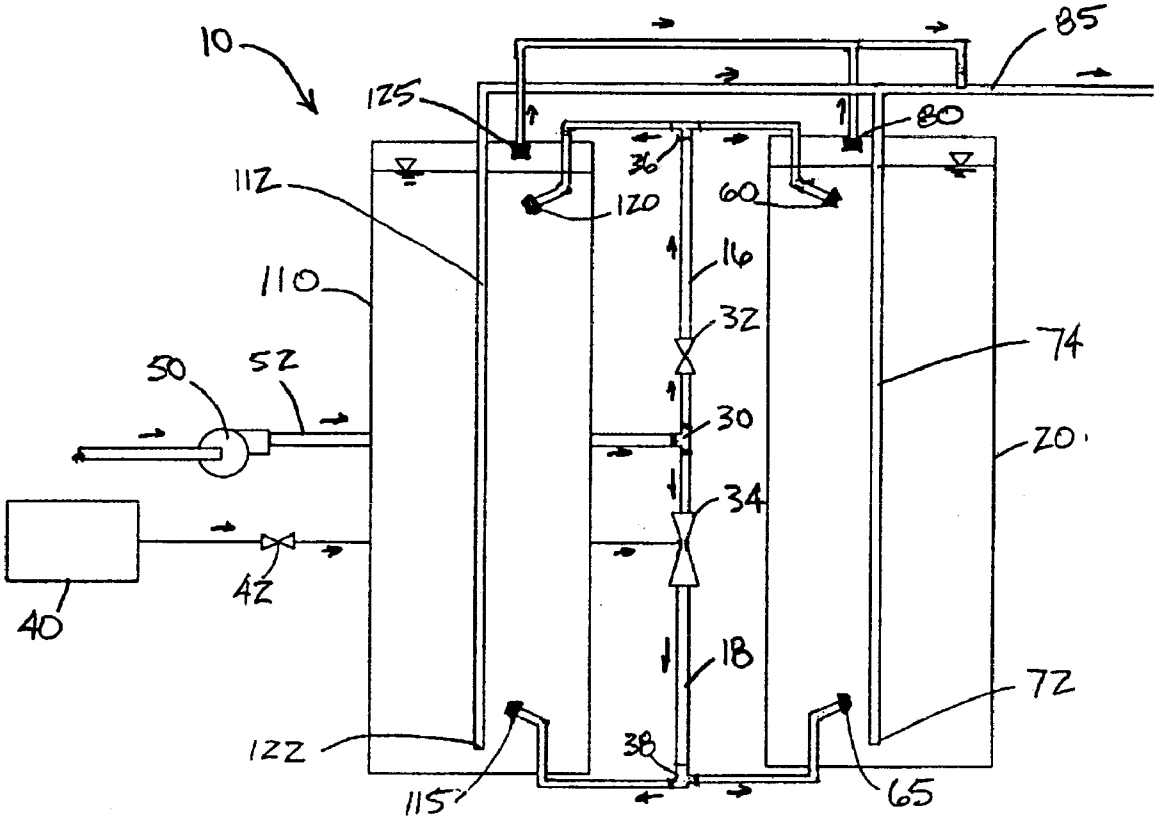
FIG. 4 is a front view of a second embodiment of the present invention.
Figure 5:
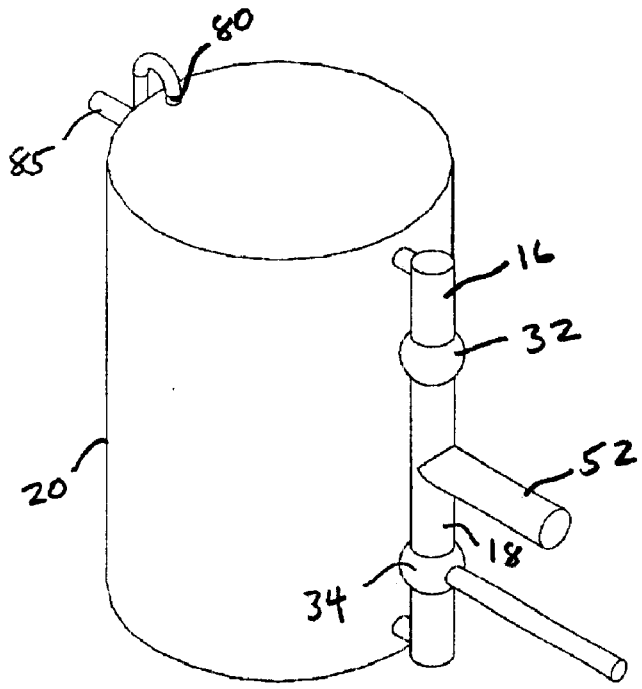
FIG. 5 is an isometric view of the invention.
Figure 6:
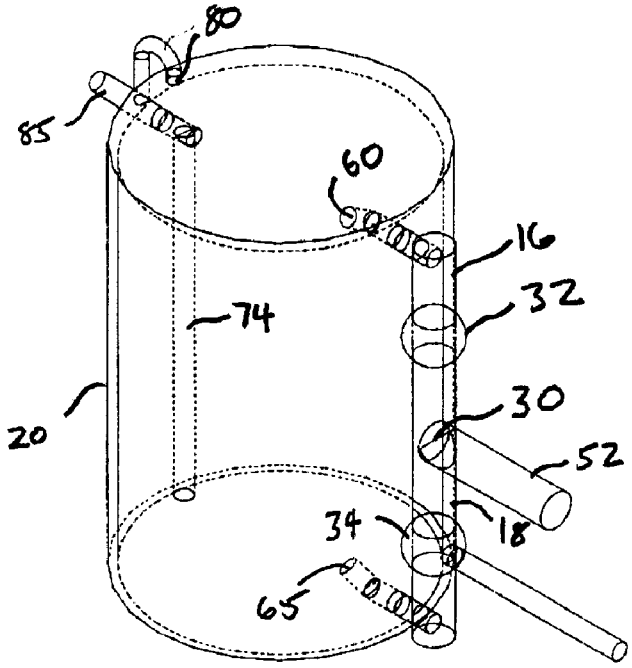
FIG. 6 is a partially sectional isometric view of the invention.
Figure 1:
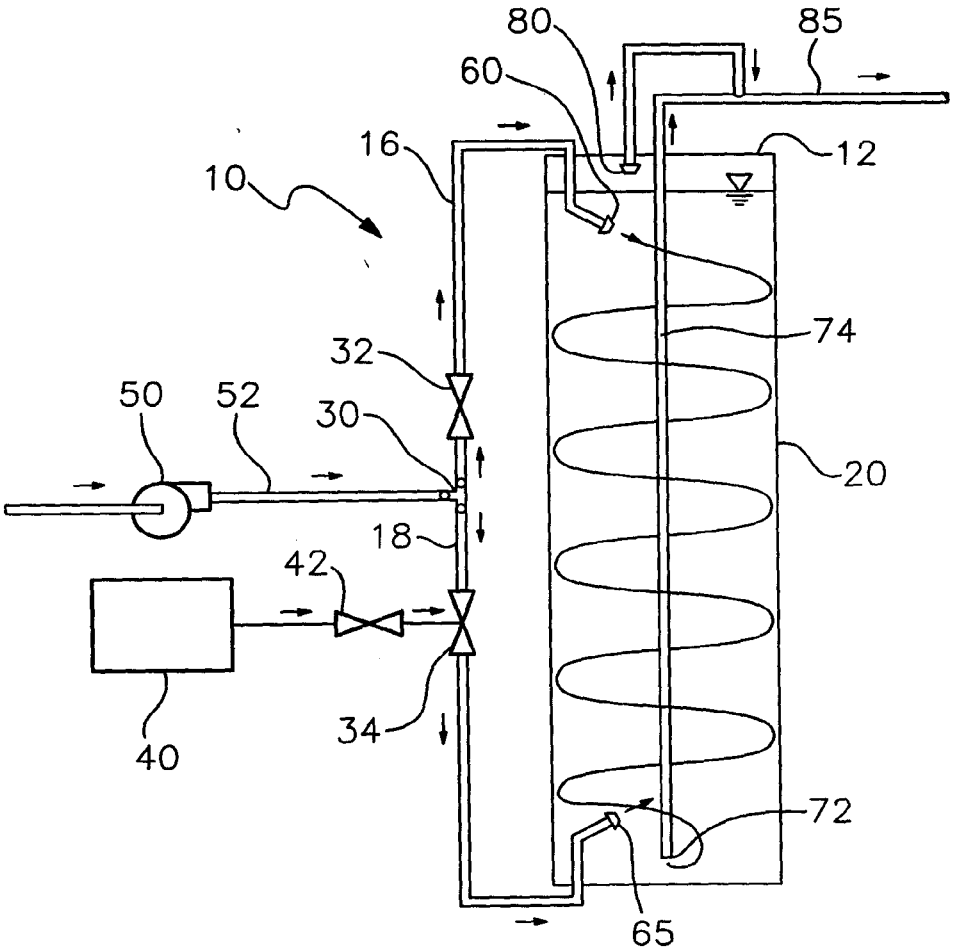
Figure 2:
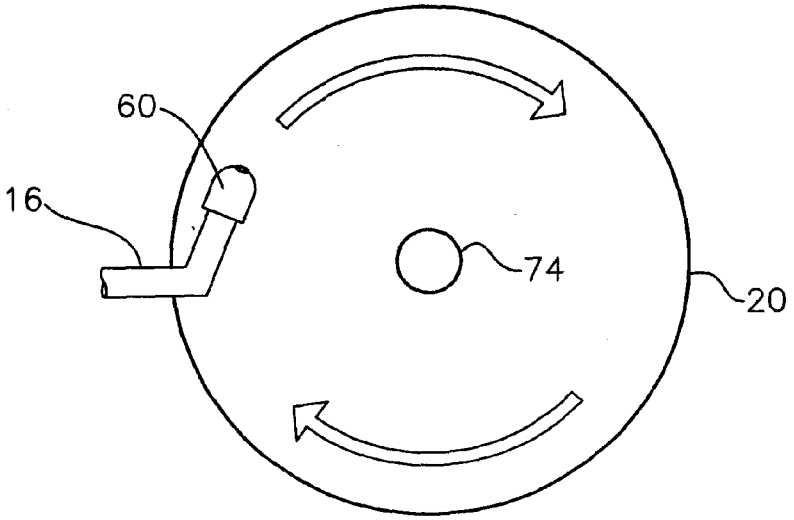
Figure 3:
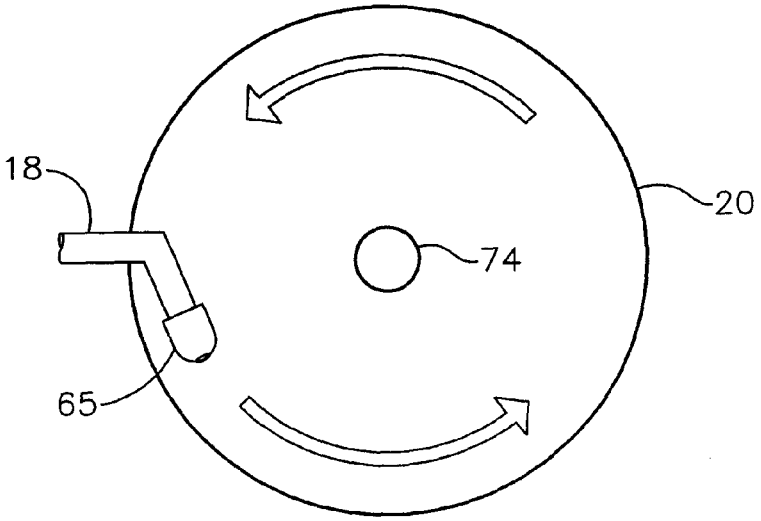
Figure 4:
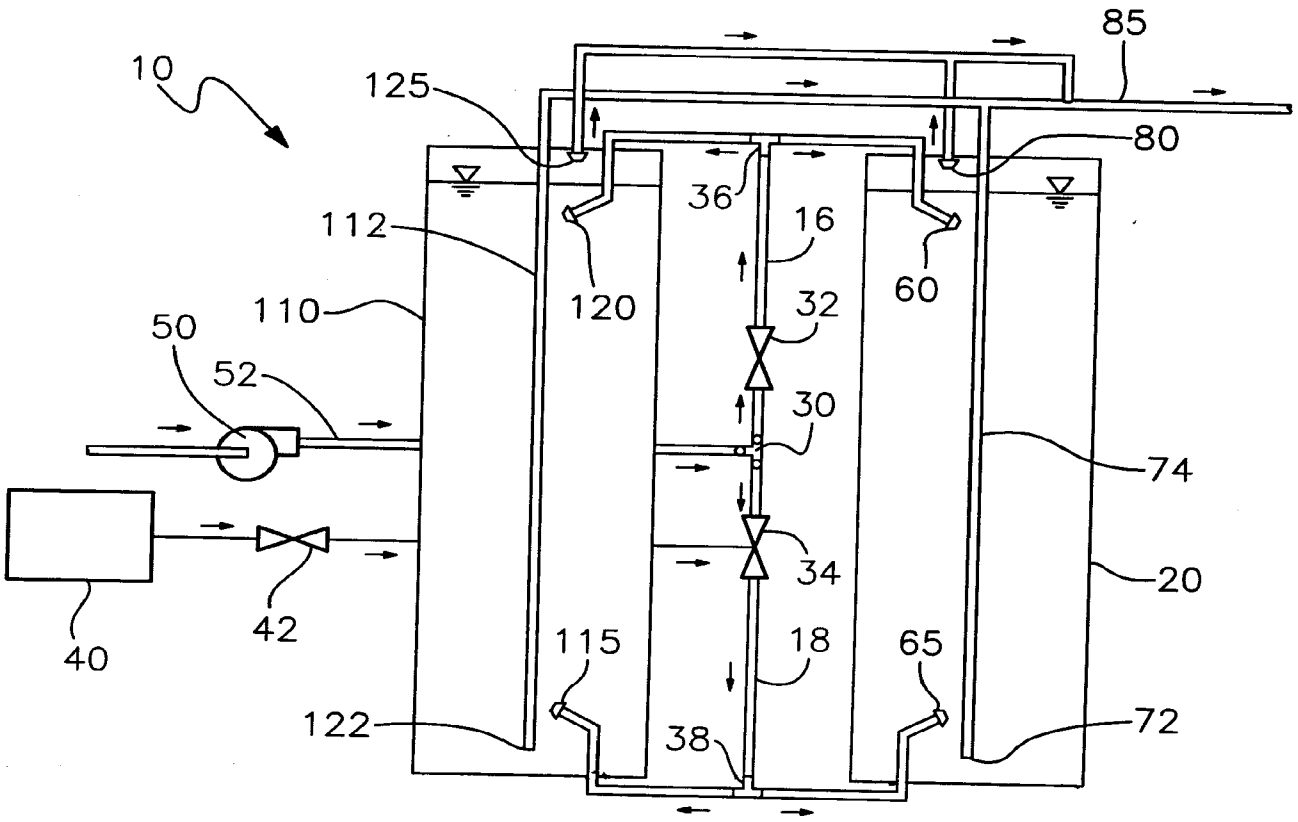
Figure 5:
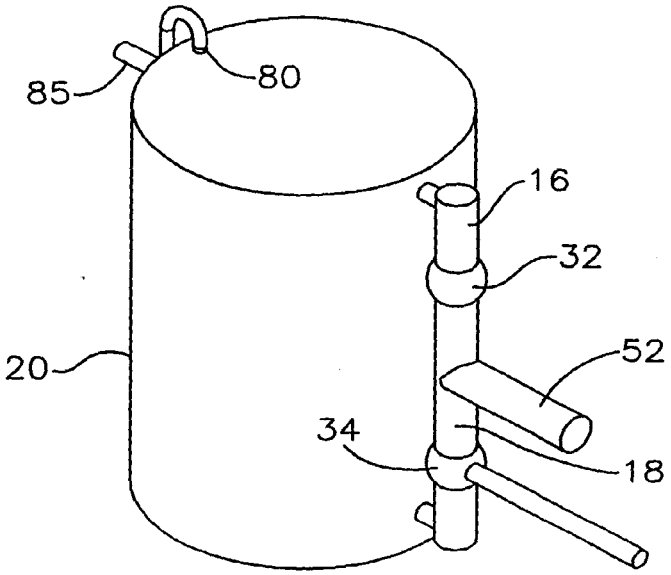
Figure 6:
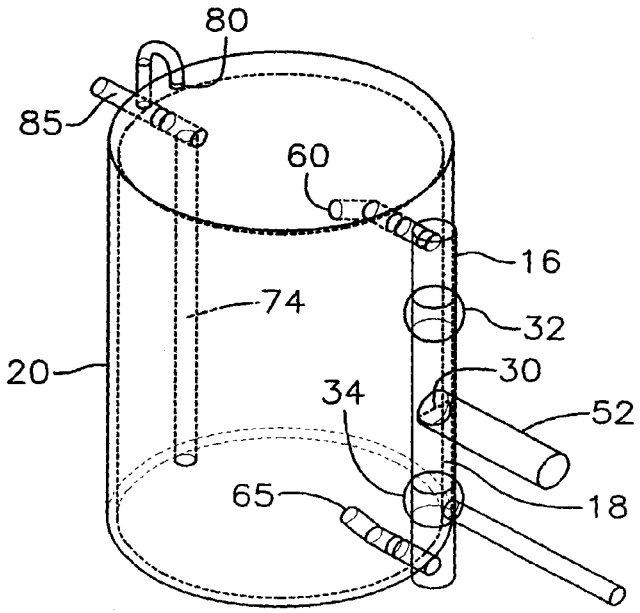

In an alternative embodiment of the invention, among others, as shown in FIG. 4, a second contactor 1 10 is disposed in parallel relation to first contactor 20. Supply pump 50 pumps liquid from a remote source to flow splitter 30 via inlet conduit 52. Liquid flows through conduit 52, wherein the flow is split into two influent conduits 16 and 18 and respective upper and lower streams. The upper stream is then divided so that a portion of upper stream flow is directed to first contactor 20 and second contactor 1 10. Likewise, the lower stream is split so that a portion of the lower stream is directed to the first contactor 20 and second contactor 110. The flow directed to the first and second contactors 20, 110 can be adjusted to meet the requirements for the apparatus.

Fluid flow directing means 65 and 115, introduces the gas-enriched lower stream into the interior of parallel contactors 20 and 110, respectively. Lower fluid flow directing means 65 and 115 produce a vortex flowably introducing the lower stream tangentially to the inside wall of the respective contactor. Additionally, fluid flow directing means 65 and 115 are angled upwardly to discharge the gas-enriched flow towards the top of contactors 20 and 110, respectively. As the lower stream is discharged, gas that was entrained within the liquid within gas injection means 34 is released into contactors 20 and 110 as gas bubbles. First ends 72 and 122 of discharge conduits 74 and 112, respectively, are disposed proximate to the bottom of contactors 20 and 110, respectively. Liquid flows upwards under pressure to outlet conduit 85. Gas collectors 80 and 125 are located proximate to the top of contactors 20 and 110, respectively, and collect and recirculate the gas to outlet conduit 85 of the effluent. The use of a second contactor in parallel configuration can either decrease the liquid flow rate, which increases the contact time in the columns, or in the alternative the flow rate can be proportionally increased. Any number of additional contactors can be employed to even further improve the efficiency of gas-liquid contact and the dissolution of gas in a liquid.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A contacting apparatus that increases the efficiency of the transfer of gas to a liquid, comprising:

a contactor adapted to receive liquid from a remote source of liquid, the contactor having an upper end and a lower end;

a flow splitter dispose between the remote source of liquid and the contactor;

a flow adjustment means disposed between the flow splitter and the. upper end of the contactor;

a gas injection means disposed between the flow splitter and the lowermost end of the contactor, the gas injection means adapted for fluid communication with a remote source of gas;

an upper fluid flow directing moans disposed proximate to the upper end of the contractor at a preselected downward angle so that the liquid follows a downward vortex path of travel within the contractor, a lower fluid flow directing means disposed proximate to the lower end of the contactor at a preselected upward angle so that the gas follows an upward vortex path of travel;

an outlet disposed proximate to the lower end of the contactor; and a mixing zone created by the downward vortex flow of liquid and the upward vortex flow of gas.

2. The contacting apparatus of claim 1 further comprising a gas collector proximate to the top of the tank adapted to collect gas not transferred to the liquid and to recirculate the gas to an outlet conduit.

3. The contacting apparatus of claim 1 wherein the gas injecting means is an eductor.

4. The contacting apparatus of claim 1 wherein the preselected downward angle of the upper fluid flow directing means is not less than 25 degrees and not more than 50 degrees.

5. The contacting apparatus of claim 1 wherein the preselected upward angle of the lower fluid flow directing means is not less than 25 degrees and not more than 50 degrees.

6. The contacting apparatus of claim 1 wherein the preselected flow rate of the upper stream is about 80 percent of the liquid source and the lower stream desired flow rate is about 20 percent of the liquid source.

7. The contacting apparatus of claim 1 wherein the upper stream flow rate is at least 50 percent and not more than 80 percent.

8. The contacting apparatus of claim 1 wherein the lower stream flow rate is at least 20 and not more than 50 percent.

9. A contacting apparatus that increases the efficiency of the transfer of a first liquid to a second liquid, comprising:

a contactor adapted to receive a first liquid from a remote source of the first liquid, the contactor having an upper end and a lower end;

a flow splitter disposed between the remote source of first liquid and the contactor;

a flow adjustment means disposed between the flow splitter and the upper end of the contactor;

a fluid injection means disposed between the flow splitter and the lowermost end of the contactor, the fluid injection means adapted for fluid communication with a remote source of a second liquid, the second liquid having a lesser density than the first liquid;

an upper fluid flow directing means disposed proximate to the upper end of the contactor at a preselected downward angle so that the first liquid follows a downward vortex path of travel within the contractor;

a lower fluid flow directing means disposed proximate to the lower end of the contactor at a preselected upward angle so that the second liquid follows an upward vortex path of travel;

an outlet disposed proximate to the lower end of the contactor; and a mixing zone created by the downward vortex flow of first liquid and the upward vortex flow of second liquid.

10. The contacting apparatus of claim 9 further comprising a second liquid collector proximate to the top of the tank adapted to collect the second liquid not transferred to the first liquid and to recirculate the second liquid to an outlet conduit.

11. The contacting apparatus of claim 9 wherein the fluid injecting means is an eductor.

12. The contacting apparatus of claim 9 wherein the preselected downward angle of the upper fluid flow directing means is not less than 25 degrees and not more than 50 degrees.

13. The contacting apparatus of claim 9 wherein the preselected upward angle of the lower fluid flow directing means is not less than 25 degrees and not more than 50 degrees.

14. The contacting apparatus of claim 9 wherein the preselected flow rate of the upper stream is about 80 percent of the first liquid source and the lower stream desired flow rate is about 20 percent of the first liquid source.

15. The contacting apparatus of claim 9 wherein the upper stream flow rate is at least 50 percent and not more than 80 percent.

16. The contacting apparatus of claim 9 wherein the lower stream flow rate is at least 20 and not more than 50 percent.

* * * * *

UNITED STATES PATENT AND TRADEMARK OFFICE

CERTIFICATE OF CORRECTION

PATENT NO. : 6,464,210 B1 
DATED : October 15, 2002
INVENTOR(S) : Alfredo J. Teran et al.

It is certified that error appears in the above-identified patent and that said Letters Patent is hereby corrected as shown below:

Title page,
Showing an illustrative figure, should be deleted and substitute therefore the attached title page.

Drawings,
Delete Drawing Sheets 1-4, and substitute therefore the Drawing Sheets, consisting of Figs. 1-6, as shown on the attached pages.

Column 6,
Line 36, delete ".", so it reads:
-- splitter and the [.] upper end of the contactor --

Signed and Sealed this

Twenty-fifth Day of March, 2003

JAMES E. ROGAN
*Director of the United States Patent and Trademark Office*

(12) United States Patent
Teran et al.

(10) Patent No.: US 6,464,210 B1
(45) Date of Patent: Oct. 15, 2002

(54) FLUID DISSOLUTION APPARATUS

(75) Inventors: Alfredo J. Teran, Cape Canaveral, FL (US); Richard G. Wood, Merritt Island, FL (US); Nidal A. Samad, Merritt Island, FL (US); Timothy N. Tyndall, Cape Canaveral, FL (US); Wesley Todd Willoughby, Merritt Island, FL (US)

(73) Assignee: Agrimond, LLC, Cape Canaveral, FL (US)

( * ) Notice: Subject to any disclaimer, the term of this patent is extended or adjusted under 35 U.S.C. 154(b) by 0 days.

(21) Appl. No.: 10/063,115

(22) Filed: Mar. 22, 2002

(51) Int. Cl.[7] ..... B01F 3/04; B01F 15/04

(52) U.S. Cl. ..... 261/79.2; 366/165.4; 366/165.5; 366/173.2

(58) Field of Search ..... 261/37, 66, 79.2, 261/DIG. 75; 210/218, 220, 221.2, 752; 366/165.1, 165.4, 165.5, 173.1, 173.2

(56) References Cited

U.S. PATENT DOCUMENTS

| | | | | | |
|---|---|---|---|---|---|
| 1,213,887 | A | * | 1/1917 | Krause | 261/79.2 |
| 3,425,669 | A | * | 2/1969 | Gaddis | 366/165.5 |
| 3,495,384 | A | * | 2/1970 | Alliger | 261/79.2 |
| 3,990,870 | A | * | 11/1976 | Miczek | 261/79.2 |
| 4,834,343 | A | * | 5/1989 | Boyes | 261/79.2 |
| 5,865,995 | A | | 2/1999 | Nelson | |
| 5,881,574 | A | * | 3/1999 | Petrich | 261/79.2 |
| 5,968,352 | A | | 10/1999 | Ditzler | |
| 6,054,046 | A | | 4/2000 | Nelson | |
| 6,065,860 | A | * | 5/2000 | Fuchsbichler | 366/165.5 |
| 6,090,294 | A | | 7/2000 | Teran et al. | |
| 6,106,731 | A | | 8/2000 | Hayes | |
| 6,207,064 | B1 | | 3/2001 | Gargas | |
| 6,238,912 | B1 | * | 5/2001 | Moore et al. | 261/79.2 |
| 6,254,838 | B1 | | 7/2001 | Goede | |

OTHER PUBLICATIONS

The Injector Sparger Gas Contacting System; REMCO Engineering, Water Systems and Controls; http://www.rem-co.com/injector.html; Nov. 12, 2001.

* cited by examiner

*Primary Examiner*—C. Scott Bushey
(74) *Attorney, Agent, or Firm*—Anton J. Hopen; Smith & Hopen, PA

(57) ABSTRACT

An apparatus for the efficient dissolution of fluids, both gas to liquid and liquid to liquid. A flow splitter divides the influent to an upper and lower stream. The lower stream is injected with a gas and the gas-enriched lower stream is subsequently discharged proximate to the bottom of a contactor in tangential fashion. The upper stream is discharged in similar tangential fashion proximate to the top of the contactor producing a vortex flow pattern. The countercurrent flow of the gas-enriched lower stream and upper stream ensures a high degree of dissolution of the gas in the liquid. Alternatively, two liquids of differing densities may be dissolved together with the present invention.

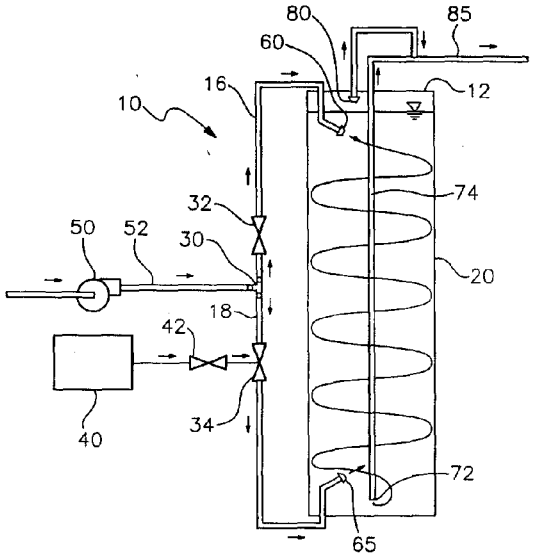

16 Claims, 4 Drawing Sheets